US005623275A

United States Patent [19]

Miller

[11] Patent Number: 5,623,275

[45] Date of Patent: Apr. 22, 1997

[54] ARTICULATED MESSAGE DISPLAY MATRIX

[76] Inventor: Paul A. Miller, 336 Webster St., Marshfield, Mass. 02050

[21] Appl. No.: 331,989

[22] Filed: Oct. 31, 1994

[51] Int. Cl.[6] ..... G09G 3/14

[52] U.S. Cl. ..... 345/46; 40/610; 340/815.49

[58] Field of Search ..... 345/30, 31, 44, 345/46, 56, 59, 905; 40/489, 490, 491, 492, 493, 606, 610; 340/815.45, 815.49, 815.73, 815.77

[56] References Cited

U.S. PATENT DOCUMENTS 4,173,035 10/1979 Hoyt .
4,194,313 3/1980 Downing .
4,821,787 4/1989 Swanson .
5,162,696 11/1992 Goodrich .
5,263,272 11/1993 Fogelman .

FOREIGN PATENT DOCUMENTS 2143984 2/1985 United Kingdom .
2269927 2/1994 United Kingdom .

*Primary Examiner*—Ulysses Weldon
*Assistant Examiner*—Regina Liang
*Attorney, Agent, or Firm*—Regina A. Loughran

[57] ABSTRACT

Articulated display matrix apparatus for providing moving or flashing variable messages is disclosed. The apparatus is highly adaptable and portable. Because the linear arrays of display cells are durably enclosed, as well as articulated, they can shipped and stored compactly. Because of their light weight and their highly-flexible structure they can be mounted in a variety of configurations and on a variety display panel shapes, without tools. The display matrix arrays can provide a continuous combined display matrix that is extensible in two dimensions.

17 Claims, 3 Drawing Sheets

22
26
11
20
10a
30a
16a
28a
28b
32a
12a
28c
20
10b
30b
16b
32b
14
12b
30c
10c
20
18
32c
12c
22
30d
12d
10d
32d
10e
30e
22
26
31
33
32
18
28
10
2
2
20
14
16
30
23
27
x
31
y
24
11
24

ARTICULATED MESSAGE DISPLAY MATRIX

BACKGROUND OF THE INVENTION

1. Field of the Invention

The present invention pertains to message display matrixes. More particularly, the present invention pertains to portable message display matrixes.

2. Discussion of Related Art

Point-of-sale advertising boards and convention booth advertising frequently use alphanumeric matrixes that provide moving or flashing displays of variable messages to attract and secure the attention of passers-by. The display matrixes must be adaptable, to satisfy changing design requirements. Both the display matrixes and the structural units supporting them must be readily portable.

When the display matrixes are integral with the board or the booth that supports them, the structural units become bulkier, and more awkward to ship and to store. In particular, the size of the units that support the display matrixes makes it difficult to protect those matrixes, and the weight of the units makes it difficult to prevent them from damaging display matrixes on adjacent units during shipping.

SUMMARY OF THE INVENTION

Display matrix apparatus in accordance with the present invention includes first and second display cells. Each cell has a display plane, a hinge having a hinge axis, and a respective light-weight enclosure. The enclosures each have an angled side that permits rotation of the cells in the articulated matrix about the hinge with a reduced separation between the cells.

In particular embodiments, the angled side defines an oblique plane that forms an acute angle with a plane parallel to the display plane at the hinge axis.

In one embodiment, the angled side defines an oblique plane forward of the hinge axis, such that the cells in the articulated matrix can rotate forward about the hinge axis without damaging display elements on the display plane.

In a preferred embodiment, the backwall and angled sides of the enclosures are made from a light-weight metal sheet. The angled sides of the enclosures are partially open. This provides a very light-weight enclosure and permits cables electrically connecting the repective display planes to move freely when the enclosures are rotated about the hinge axis, without pinching the cables.

The light-weight, articulated construction of apparatus in accordance with the present invention permits a hook fabric to quickly and reliably attach the apparatus to napped fabric surfaces having a wide variety of shapes.

BRIEF DESCRIPTION OF THE DRAWINGS

The features and advantages of the present invention will be better understood when the detailed description of a preferred embodiment given below is considered in conjunction with the drawings provided, wherein.

In these figures, similar reference numerals indicate similar structures.

DETAILED DESCRIPTION OF THE PREFERRED EMBODIMENTS

Figures 1, 1A:
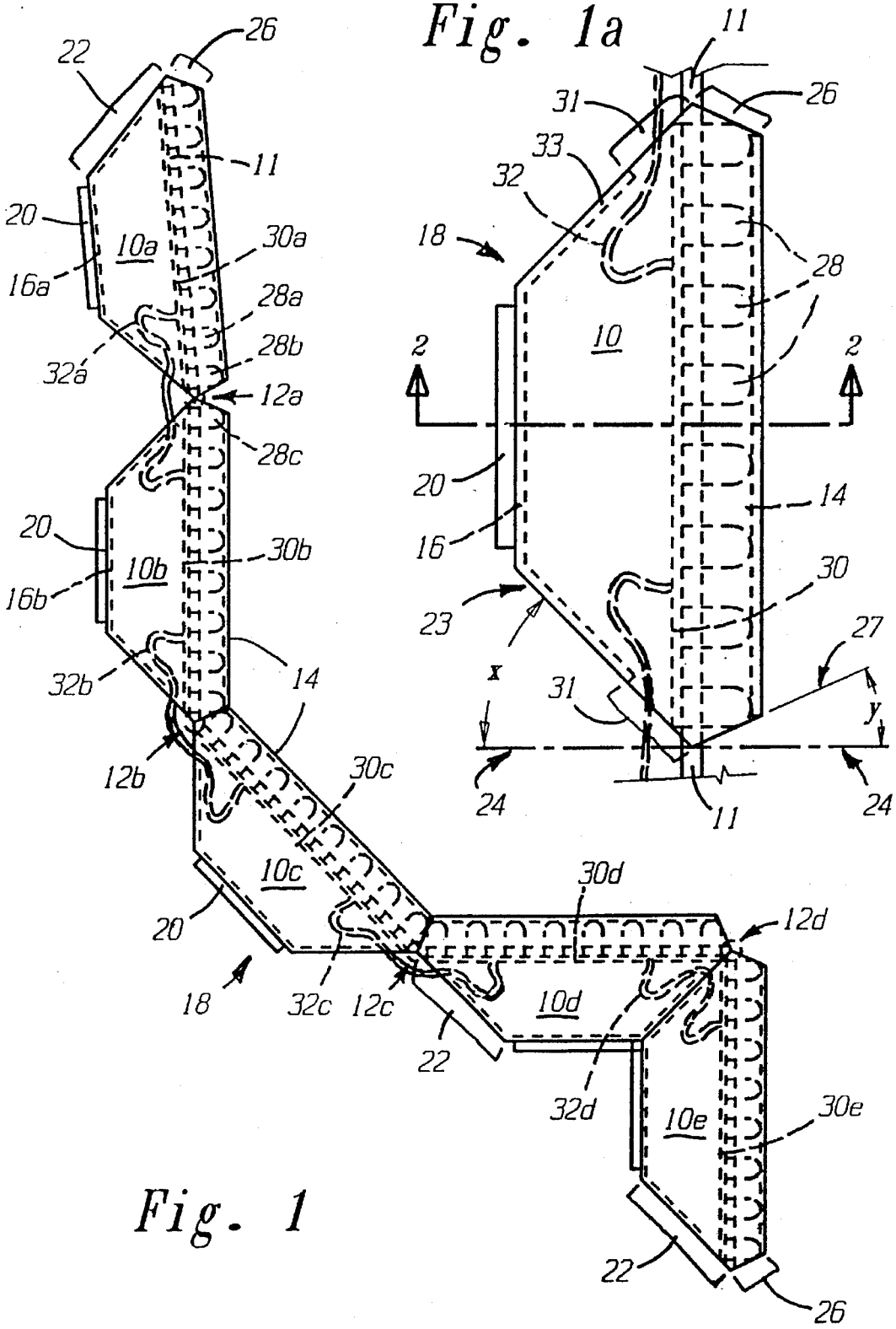
FIGS. 1 and 1*a* are a plan view of an array of hinged display cells viewed from above, and a detail of that plan view showing a cell cut out of the center of the array, respectively.

FIG. 1 shows a linear array of display cells 10 in accordance with the present invention. A first display cell 10*a* is attached to the next display cell 10*b* by a tough, continuous plastic web 11 having a hinge axis 12*a*. The array provides an easy-to-use, highly-adaptable apparatus for producing electronically-controlled variable messages suitable for portable displays used in point-of-sale advertising and convention booths.

The display cells in FIG. 1 are flexed about hinge axes 12*a* through 12*d* to position adjacent display planes 14 of the cells 10 at a shallow convex oblique angle (12*a*), 45-degree concave angles (12*b*) and (12*c*), and a 90-degree convex angle (12*d*), respectively. This articulation makes the message display apparatus highly adaptable. It can be compactly stored, and is conformable to the curves and corners on irregular display surfaces, such as the one shown in FIG. 3.

Between the backwall 16 of the cell 10 and the hinge axis 12, a rear portion 22 of the side of each enclosure 18 is cutaway or angled so as to define a first oblique plane 23 extending aft of and including the hinge axis 12. This oblique plane 23 intersects a plane 24 that includes the hinge axis 12 and is perpendicular to the display plane 14, at an angle "x" of 45 degrees.

The front portion 26 of each enclosure 18, likewise, is angled and defines a second oblique plane 27 including the hinge axis 12. This second oblique plane 27 intersects the perpendicular plane 24 at an angle "y" that is one-half the size of angle "x". This forward cutaway permits the distance between cells 10 at the hinge axis 12 to be minimized, without interfering with the rotation of each cell through 135 degrees relative to the next.

As shown more clearly in FIG. 1*a*, a rectangular array of equidistant light-emitting diodes (LEDs) 28 is affixed to a printed circuit board 30. The circuit board 30 is parallel to the display plane 14 defined by the forward ends of the display elements 28 in each cell 10. When the circuit boards 30 are aligned so that the respective display planes 14 are co-planar, forming a 180 degree angle with each other, the distance between adjacent first and second LEDs 28*b* and 28*a* on one circuit board 30*a* is the same as the distance between adjacent LEDs 28*b* and 28*c* on the respective circuit board 30*b* across the hinge axis 12*a*. This element spacing provides a linear array of cells having a combined display matrix that appears to be continuous.

The circuit board 30*c* is electrically linked to the circuit boards 30*b* and 30*d* in adjacent cells 10*b* and 10*d* by respective flexible flat cables 32*b*, 32*c*. The cables 32 pass through openings 31 in the side walls 33 of the respective cells 10. The openings 31 allow free movement of the cables, preventing cables such as the cable 32*d* from becoming pinched when the cells 10*d* and 10*e* are rotated to mount them on the convex right angle 50 shown in FIG. 3. This permits cables electrically connecting the repective cells to move freely when the cells are rotated about the hinge axis.

Preferrably, the respective open angled back portions 22 of the tubular enclosures 18 on each side of a given hinge axis 12 are partially enclosed by sidewalls 33, to protect the circuit board from dirt, foreign objects, and static electricity. The sidewalls are made of thin, light-weight metal sheet that is contiuous with the backwall 16. The sheet is folded forward at a 45-degree angle along respective Sides of the backwall, but stop short of the hinge axis leaving a gap in the enclosure, behind the circuit board 30 which provides the opening 31 for free movement of the cables 32 between the respective enclosures 10.

Alternatively a thin, flexible one-piece web (not shown) made of a pliable poly-urethane may be attached with adhesive to the top and bottom extrusions 34 and the backwall 16 of each enclosure 18. This web would extend from one backwall 16*a* to the next 16*b* to flexibly seal larger openings 31, in place of the partially open sidewalls 33. Also, the cables 32 connecting the circuit boards 30 may be embedded in the flexible web hinge 11. The open sides of the enclosure may then be closed by metal or plastic sheets and the enclosures may be sealed by metal or plastic sheets.

The apparatus is particularly adaptable because it is light-weight enough to be attached to supporting structures by hook-and-loop fasteners. Specifically, the backwall 16 in the enclosure 18 of each cell 10 is covered by a strip of hook fabric 20 attached to the backwall by adhesive.

Figure 2:
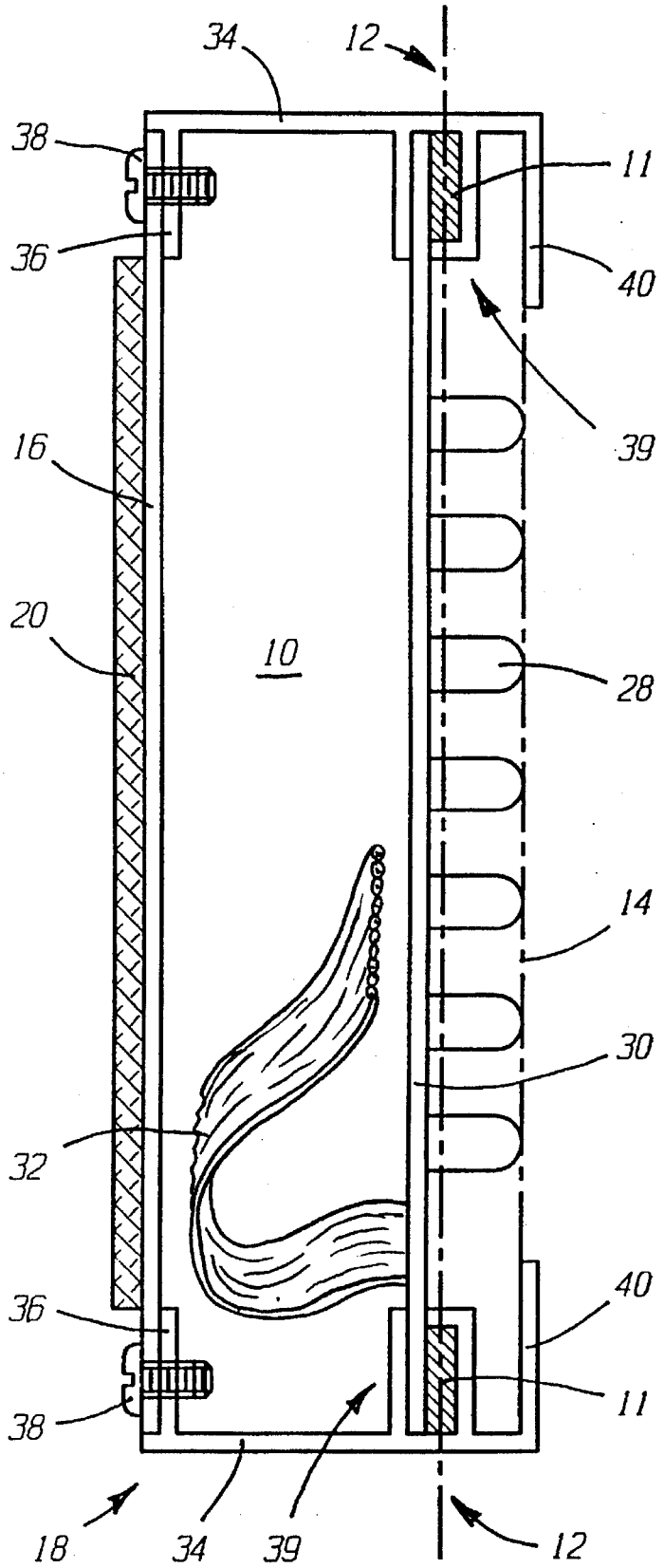
FIG. 2 is a schematic cross-section view of a single display cell taken perpendicular to the display face and parallel to the hinge axes of the display cell enclosure.

FIG. 2, is a section view taken along the section line 2—2 of the cell 10 shown in FIG. 1*a*. The enclosure 18 of each cell 10 is formed of two light-weight extruded metal sections 34 attached to the top and bottom of a bent sheet of light-weight metal that provides the backwall 16 and sidewalls 33 of the enclosure 18. The backwall 16 extends along the width of the adjacent edges of the respective extrusions 34, and is attached to right-angle surfaces 36 on the extrusions 34 by four fasteners 38. Preferably, the edges of the circuit board 30 are mounted with adhesive into a channel 39 in each extrusion 34. Alternately, they may be press-fit and crimped into the channel. The extension surfaces 36 and the channels 39 in the extrusion integrate the backwall 16 and circuit board 30 to form a stable, rigid box-like structure which can accomodate auxilliary circuit elements or auxilliary circuit boards including power regulators or power drivers, and microprocessor control circuits within the enclosure.

The extrusions 34 have cutaway portions 22, 26 aft and forward of each hinge axis 12, that reduce the separation between the cells 10 required to permit the cells to rotate through a 135-degree arc with respect to each other. The acute angle "y" forward of the hinge axes 12 also determines the minimum clearance that is provided between the display elements 28 of the respective cells 10 when the cells are rotated about a hinge axis toward each other, such as cells 10*c* and 10*d* on either side of hinge axis 12*c*. These cutaways 26 also permit extrusions 34 to extend forward of the circuit board 30, to protect the LEDs 28.

Figure 4:
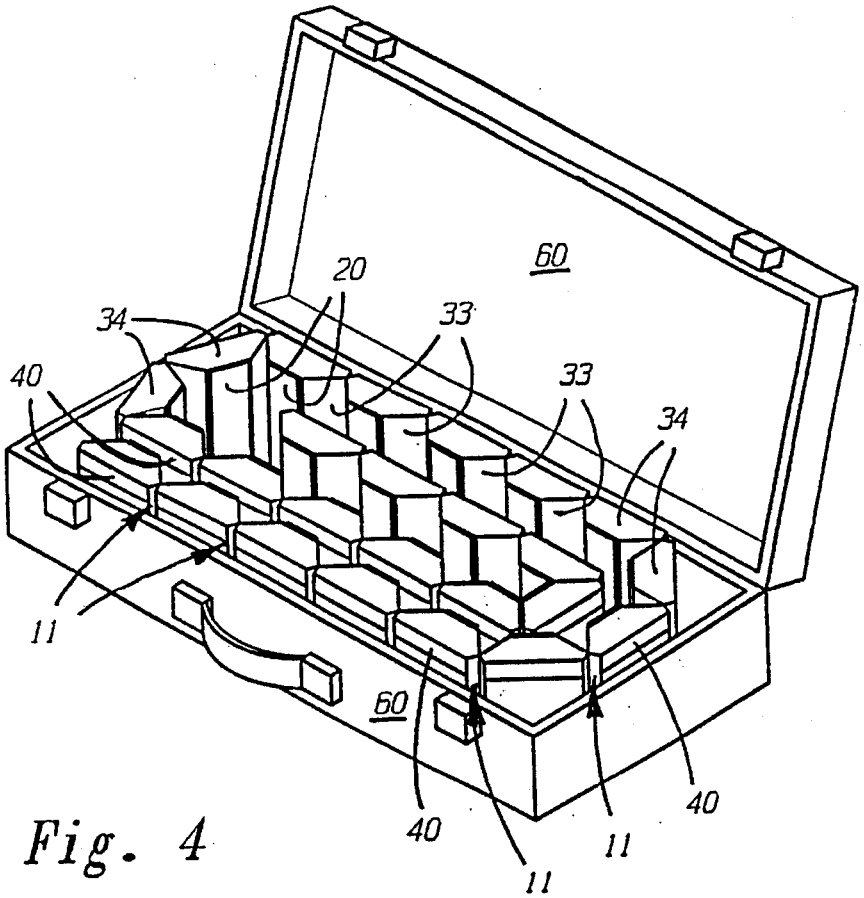
FIG. 4 shows a message display matrix in accordance with the present invention compactly coiled in a carrying case.

The extrusions 34 also have an overhang 40 that lies forward of the display plane 14. The overhang 40 cooperates with the cutaway portions 26 located forward of each hinge axis 12 to provide additional protection for the LEDs 28, as well as providing a cosmetic frame for the linear array. In particular, the overhangs 40 provide space between the LEDs 28 and the backwalls 16 of other cells 10, and the display elements 28 nearest the edges of each display plane 14 when the array is coiled about itself, as shown in FIG. 4.

In another embodiment, the cells are constructed without overhangs, so that the LED matrix extends the full height of the cell. Thus, areas otherwise covered by overhangs become part of the combined matrix. The articulated display matrix provided by this embodiment can be extended in two dimensions by stacking the linear arrays top to bottom, as well as end to end, and these stacked arrays also provide a continuous combined display matrix.

Specifically, if the distance between the top and bottom row of the elements and the respective near edge of each cell is one-half the distance between elements themselves, the combined display matrixes will be continuous between cells that are not hinged together, as well as along the length of the arrays.

Figure 3:
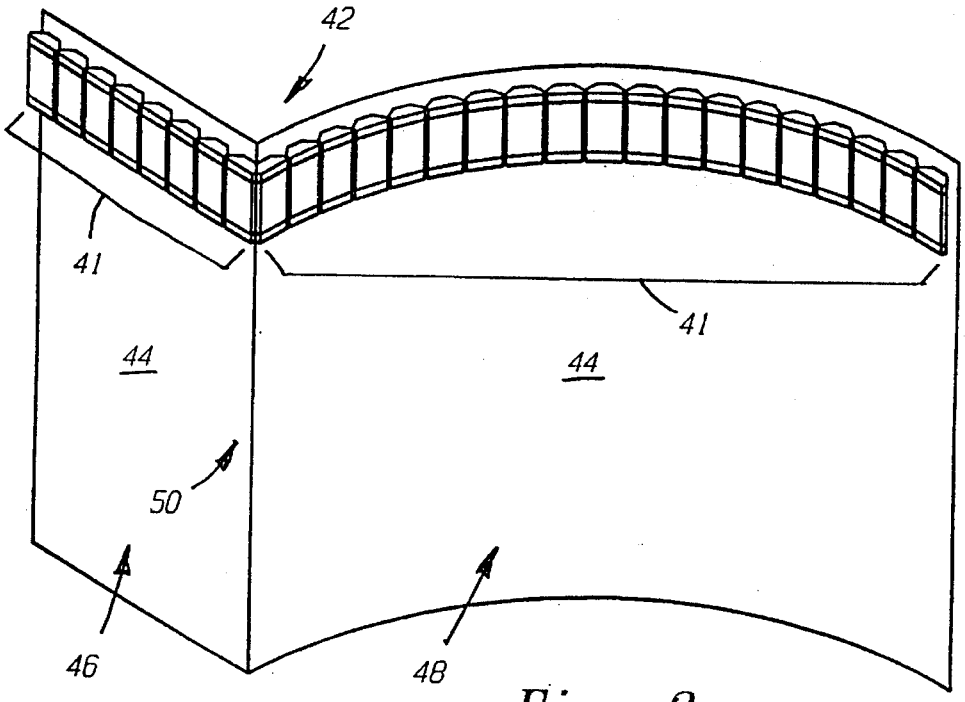
FIG. 3 shows a flexible message display matrix in accordance with the present invention mounted in an advertising booth.

Because of the light-weight construction of the enclosures 18, the hook fabric 20 securely attaches the cells 10 in the array 41 without requiring the use of tools. For example, FIG. 3 shows display arrays 41 mounted on the surface of an advertising booth 42 across the top of the napped fabric surface 44 that covers both the flat panel 46 and concave panel 48. The arrays could also be arranged vertically, or even diagonally, together or separately, on the panels 46, 48.

The flexible web hinge 11 permits the array 41 of cells 10 to conform to the convex right angle 50 between the panels 46, 48. The flexible web 11 also permits the array 41 to be mounted helically, about a column for instance.

The light-weight structure of apparatus in accordance with the present invention requires only minimal further protection from damage, thereby reducing the shipping weight and storage bulk of the arrays 41. In FIG. 4, for instance, an array 41 of cells 10 can be packed inside a simple carrying case 60 for shipping and storage, without additional cushioning.

It will be appreciated by one skilled in the art that variations and modifications of the disclosed apparatus are possible within the spirit and scope of this invention. For example, the enclosures could be formed of a sturdy plastic material by injection molding.

The embodiments described above are provided to illustrate presently preferred ways of making and using this invention. The invention is defined by the claims appended below.

I claim:

1. Display apparatus having first and second display matrix cells, said apparatus comprising:

first and second display planes, respectively, each display plane including a respective display matrix in each cell, each display matrix having a respective plurality of electrical display elements;

a respective enclosure for each cell, said respective enclosure having a backwall opposite the display plane, and a first and a second plate connecting opposite edges of the backwall to corresponding edges of the display matrix, respectively;

a hinge connecting the cells, said hinge defining a hinge axis orthogonal to said corresponding edges of said display matrix; and a first and a second edge on said first and said second plate of each respective enclosure on respective sides of said hinge, said first and second edges defining unequal first and second angles, respectively, with said corresponding edges of the display matrix, respectively, said first and second angles providing clearance for rotating the cells about the hinge so that the angle between the cells can be varied, whereby said cells form a flexible array of display matrix cells which appears to be continuous but which is rugged and can be mounted on irregular surfaces.

2. The apparatus of claim 1 wherein said angled edge provides clearance forward of the hinge axis.

3. The apparatus of claim 1 wherein said angled edge provides clearance aft of the hinge axis.

4. The apparatus of claim 1 further comprising:

an overhang extending from said first and second plate parallel to and forward of the display plane, whereby the display matrix of matrix elements is protected when the apparatus is coiled for storage and shipping.

5. The apparatus of claim 1 further comprising a hook fabric on the backwall of the enclosure, said hook fabric being adapted to releasably mount the enclosure on a napped fabric.

6. The apparatus of claim 1 wherein the hinge is a web.

7. The apparatus of claim 6 wherein said web further includes means for electrically connecting matrix. elements on the first display plane with matrix elements on the second display plane.

8. The apparatus of claim 1 further comprising:

an array of first matrix elements in each of said first and second display matrices along an edge of said respective display matrix that is proximal to said hinge axis; and a second matrix element, said second matrix element being an element on the first display matrix and being located on the opposite side of a given first matrix element from the hinge axis, said second matrix element being nearest to said hinge axis of any matrix elements located on the opposite side of the given first matrix element from the hinge axis, said given first matrix element on the first display matrix being equidistant from the corresponding first matrix element on the second display matrix and said second matrix element, said corresponding first matrix element being the first matrix element on the second display matrix nearest to said given first matrix element across the hinge axis, when the first and second display matrices form a 180-degree angle, whereby consistent display matrix element spacing is provided when the array of display matrix cells is flat.

9. Display apparatus having first and second display matrix cells, said first and second cells comprising:

a respective display plane in each cell, said display plane including a respective display matrix, each display matrix having a plurality of electrical display matrix elements;

a hinge connecting the first and second cells, said hinge having a hinge axis;

a respective enclosure for the first and the second cell, said respective enclosure including a backwall opposite said display plane; and a first and a second side on each enclosure on respective sides of said hinge, said first and second sides defining respective oblique planes one of which is oblique to said backwall, that intersect a plane that is perpendicular to the display plane and includes said hinge axis in unequal first and second angles, respectively, said oblique planes providing clearance such that the cells can be rotated about the hinge axis, whereby said display cells are formed into a flexible array that has a reduced distance between the cells so as to provide a continuous display that can be mounted on irregular surfaces.

10. The apparatus of claim 9 further comprising a hook fabric on the backwall of the enclosure, said hook fabric being adapted to releasably mount the enclosure on a napped fabric.

11. The apparatus of claim 9 further comprising:

a plurality of first matrix elements proximal to the respective edges of the first and second display matrices on either side of said hinge axis; and a second matrix element, said second matrix element being an element on the first display matrix and being located on the opposite side of a given one of the first matrix elements on the first display matrix from the hinge axis, said second matrix element being the element nearest to said hinge axis of any matrix elements located on the opposite side of the given first matrix element from the hinge axis, said given first matrix element being equidistant from a corresponding first matrix element on the second display matrix, said corresponding first matrix element being the element on the second display matrix nearest to said given first matrix element across the hinge axis, when the first and second display matrices form a 180-degree angle, whereby consistent matrix element spacing is provided when the continuous display is flat.

12. Display apparatus having first and second display matrix cells, said first and second cells comprising:

a respective display plane in each cell, said display plane including a respective display matrix, each display matrix having a plurality of electrical display matrix elements;

a hinge connecting the first and second cells, said hinge having a hinge axis;

a respective enclosure for the first and the second cell, said respective enclosure including a backwall opposite said display plane; and first and second sides on each respective enclosure on respective sides of said hinge, said first and second sides defining respective oblique planes one of which is oblique to said backwall, said oblique planes including said hinge axis and intersecting a plane that is perpendicular to the display plane and including said hinge axis in unequal first and second angles, respectively, said oblique planes providing clearance such that the cells can be rotated about the hinge axis, whereby said display cells are formed into a flexible array that has a reduced distance between the cells so as to provide a continuous display that can be mounted on irregular surfaces.

13. The apparatus of claim 12 further comprising:

plates attached to respective opposite edges of the backwall orthogonal to said hinge axis and attached to corresponding edges of the circuit board;

a first matrix element proximal to a respective corresponding edge of the circuit board; and a second matrix element, said second matrix element being the element proximal to the first matrix element and on the opposite side of the first matrix element from said corresponding edge, said second matrix element being located so that the distance between the first matrix element and the second matrix element is twice the distance between the first matrix element and the respective corresponding edge, whereby the apparatus provides consistent display matrix element spacing when arrays of display matrix cells are stacked to provide a continuous display made up of a two-dimensional matrix of display matrix cells.

14. The apparatus of claim 12 wherein the backwall is a flat sheet, said apparatus further comprising:

plates attached to opposite edges of the backwall and attached to corresponding edges of the display matrix; and a cable connecting matrix elements in the first cell to matrix elements in the second cell, said cable passing through an opening between the plates and the backwall and circuit board of each enclosure, whereby a rigid tubular enclosure is provided and damage to the cable is prevented when the cells rotate about the respective hinge axis.

15. The apparatus of claim 14 further comprising:

repective extruded section attached to opposite edge of the backwall and attached to corresponding edges of the circuit board;

a first element proximal to a respective corresponding edge of the circuit board; and a second element, said second element being proximal to the first element and on the opposite side of the first element from said corresponding edge, said second element being located so that the distance between the first element and the second element is twice the distance beteen the first element and the respective corresponding edge, whereby the apparatus provides consistent display element spacing when cells are stacked to provide a two-dimensional combination of display matrixes.

16. The apparatus of claim 12 wherein the hinge is a web including means for electrically connecting matrix elements on the first circuit board with matrix elements on the second circuit board.

17. The apparatus of claim 16 further comprising:

a sheet extending from the backwall to the circuit board, and from one plate to the other in each cell, whereby the light-weight display apparatus is protected from dirt and breakage.

* * * * *